US006033345A

United States Patent [19]

Mulvihill et al.

[11] Patent Number: 6,033,345

[45] Date of Patent: Mar. 7, 2000

[54] VAULTING HORSE TRAINING PAD

[75] Inventors: Richard Mulvihill, Eugene, Oreg.; Martha Nichols-Ketchum, Jefferson, Iowa

[73] Assignee: American Sports International, Ltd., Jefferson, Iowa

[21] Appl. No.: 09/065,833

[22] Filed: Apr. 24, 1998

[51] Int. Cl.[7] ..... A63B 5/12

[52] U.S. Cl. ..... 482/25; 482/23

[58] Field of Search ..... 482/25, 26, 27, 482/28, 29, 18, 23, 43, 15; 473/441, 442, 443, 444, 445; 119/712, 850, 856, 907; 5/401, 402, 420, 417

[56] References Cited

U.S. PATENT DOCUMENTS

| | | | |
|---|---|---|---|
| D. 168,302 | 12/1952 | Holt | 473/444 |
| 3,628,790 | 12/1971 | Gordon | 482/25 |
| 4,203,525 | 5/1980 | Okubo | 482/25 |
| 5,216,772 | 6/1993 | Clute | 5/655 |
| 5,370,591 | 12/1994 | Jewell et al. | 482/27 |

FOREIGN PATENT DOCUMENTS

| | | | |
|---|---|---|---|
| 3119860 | 12/1982 | Germany | 482/25 |
| 1389787 | 4/1988 | U.S.S.R. | 482/25 |

OTHER PUBLICATIONS

AMF American, Gymnastics Products, pp. 7 and 21, 1984.
United Athletic International, 1998 Catalog, page 6, 1998.

*Primary Examiner*—Richard J. Apley
*Assistant Examiner*—Justine R. Yu
*Attorney, Agent, or Firm*—Zarley, McKee, Thomte, Voorhees & Sease

[57] ABSTRACT

The training pad for a gymnastic vaulting horse has a first elongated pad with a vertical height substantially equal to the height of the body of the vaulting horse. A second elongated pad has a vertical height substantially equal to the combined height of the body and the supporting stand of the vaulting horse. An elongated flexible blanket has its opposite sides connected to the first and second pads and is adapted to engage and span the lateral width of the top of the body of the vaulting horse. Straps are secured to the pad for attachment of the pad to the body of the vaulting horse. The length of the pad is slightly less than the length of the body of the vaulting horse.

12 Claims, 6 Drawing Sheets

VAULTING HORSE TRAINING PAD

BACKGROUND OF THE INVENTION

A gymnastic vaulting horse is comprised of an elongated elevated substantially stiff padded body mounted on a supporting stand. Gymnasts run towards the vaulting horse, place their hands on the top of the body and perform a variety of vaulting performances.

There is some risk of injury in teaching the vaulting exercises, particularly to younger children. To successfully complete a vault, a child may have to make over 2,000 attempts in the learning process to safely complete the vault. That is the equivalent of 20 vaults a day during three days a week for a period of eight to ten months. Various miscalculations on the part of the student gymnasts can result in injury wherein the body of the gymnast is hurled into the horse body or the supporting stand. Undercutting the body with the hands or overcutting the body with the hands can also result in serious injuries.

It is therefore a principal object of this invention to provide a training pad for vaulting horses which will insure the safety of the student gymnast while training for and practicing the vaulting exercise.

These and other objects will be apparent to those skilled in the art.

SUMMARY OF THE INVENTION

The training pad for a gymnastic vaulting horse has a first elongated pad with a vertical height substantially equal to the height of the body of the vaulting horse. A second elongated pad has a vertical height substantially equal to the combined height of the body and the supporting stand of the vaulting horse.

An elongated flexible blanket has its opposite sides connected to the first and second pads and is adapted to engage and span the lateral width of the top of the body of the vaulting horse. Straps are secured to the pad for attachment of the pad to the body of the vaulting horse. The length of the pad is slightly less than the length of the body of the vaulting horse.

DESCRIPTION OF THE PREFERRED EMBODIMENT

Figure 1:
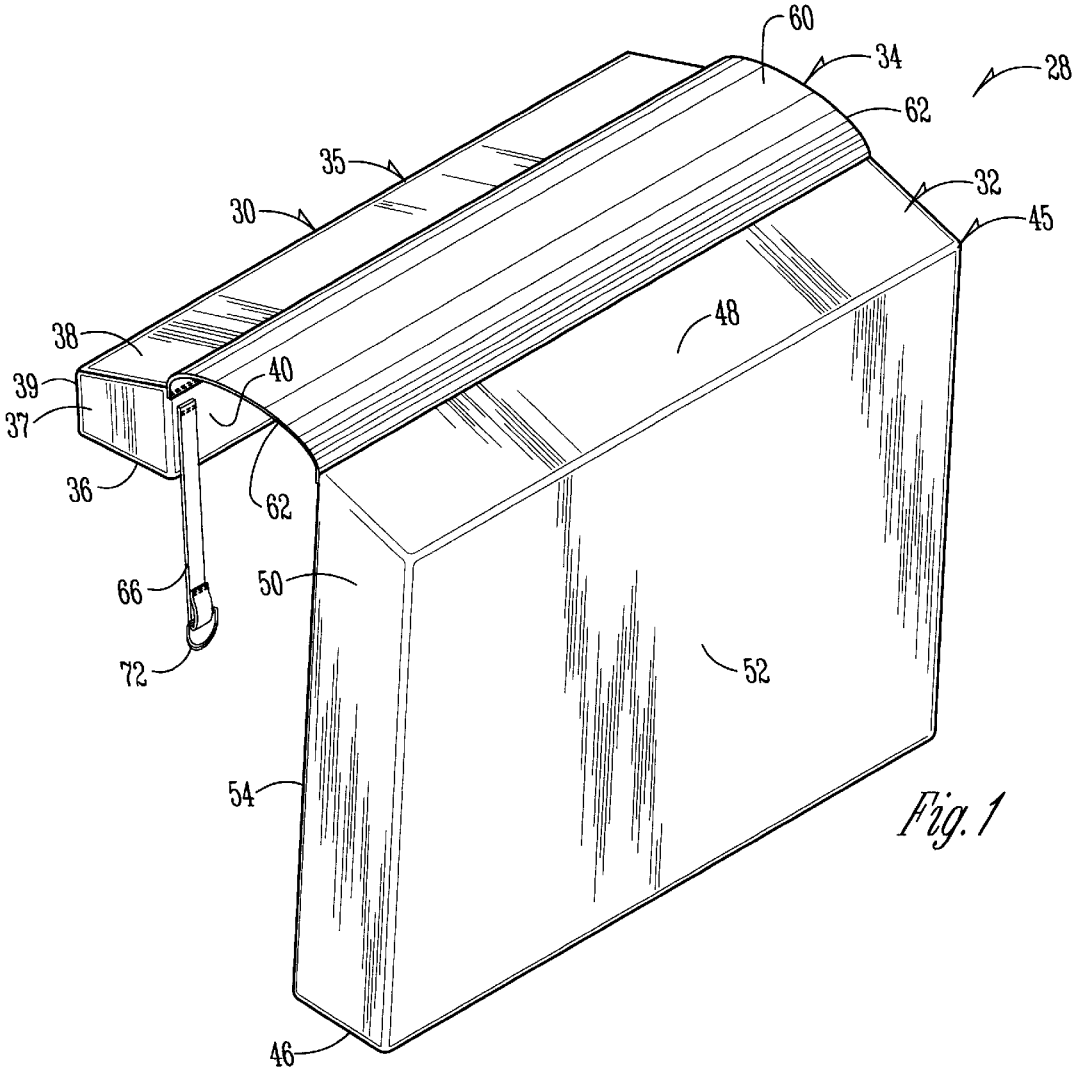
FIG. 1 is an enlarged scale perspective view of the pad of this invention.
Figure 1A:
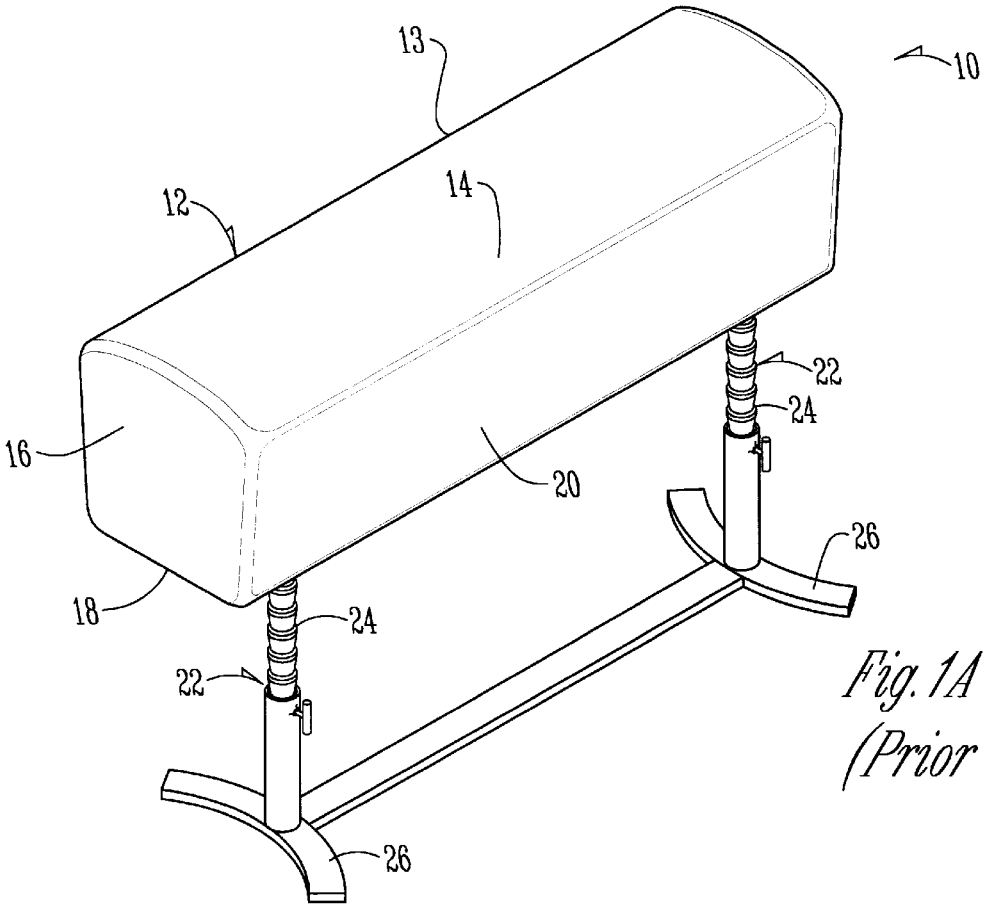
Fig. 1A (Prior Art)
FIG. 1A is a perspective view of a conventional vaulting horse.
Figure 3:
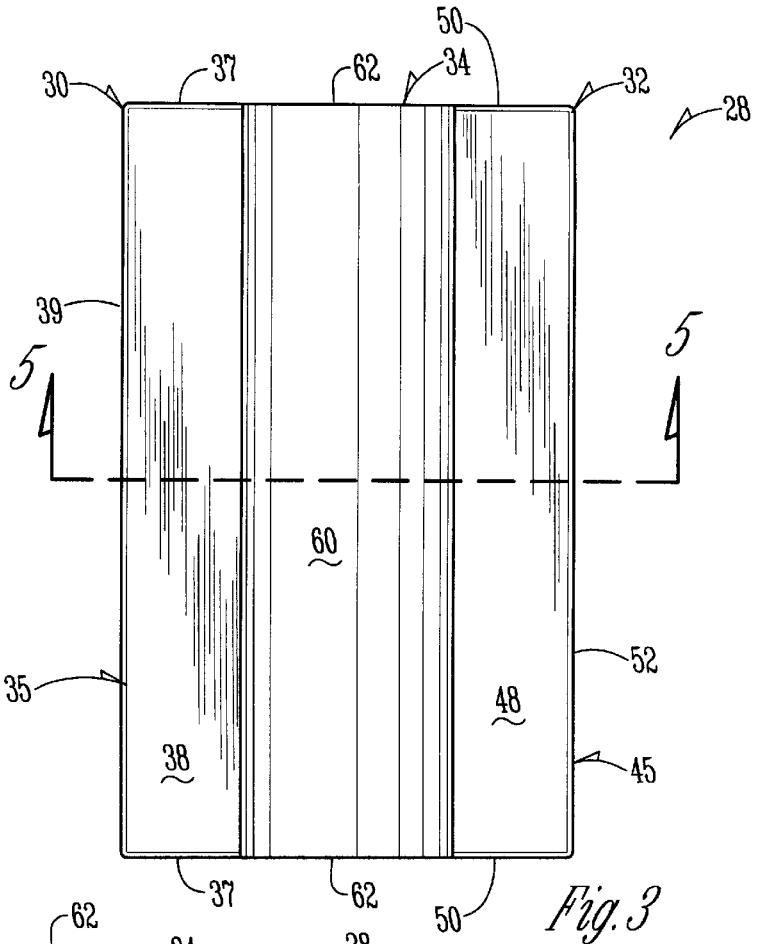
FIG. 3 is a top plan view thereof.
Figure 2:
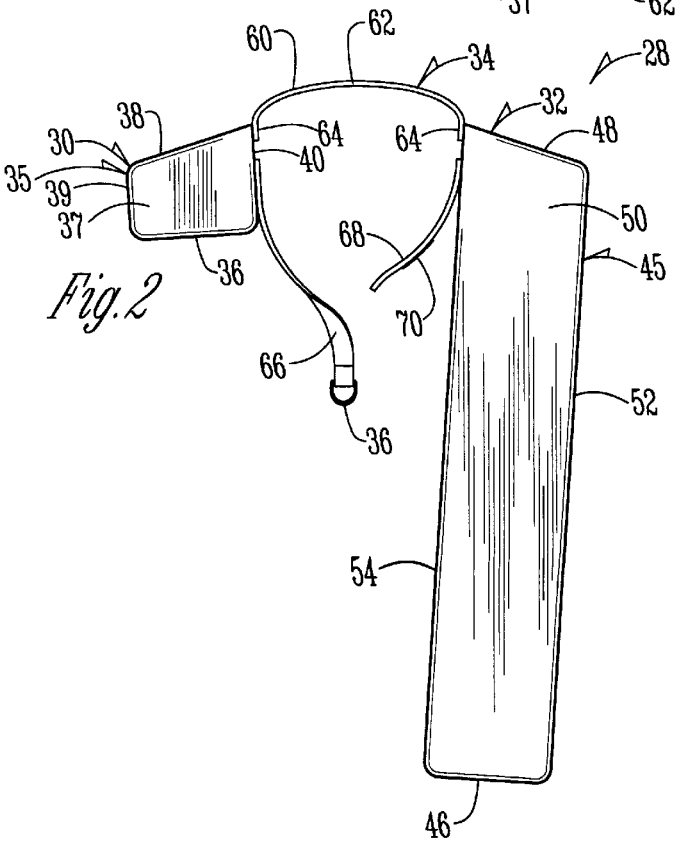
FIG. 2 is a reduced and elevational view of the pad.
Figure 4A:
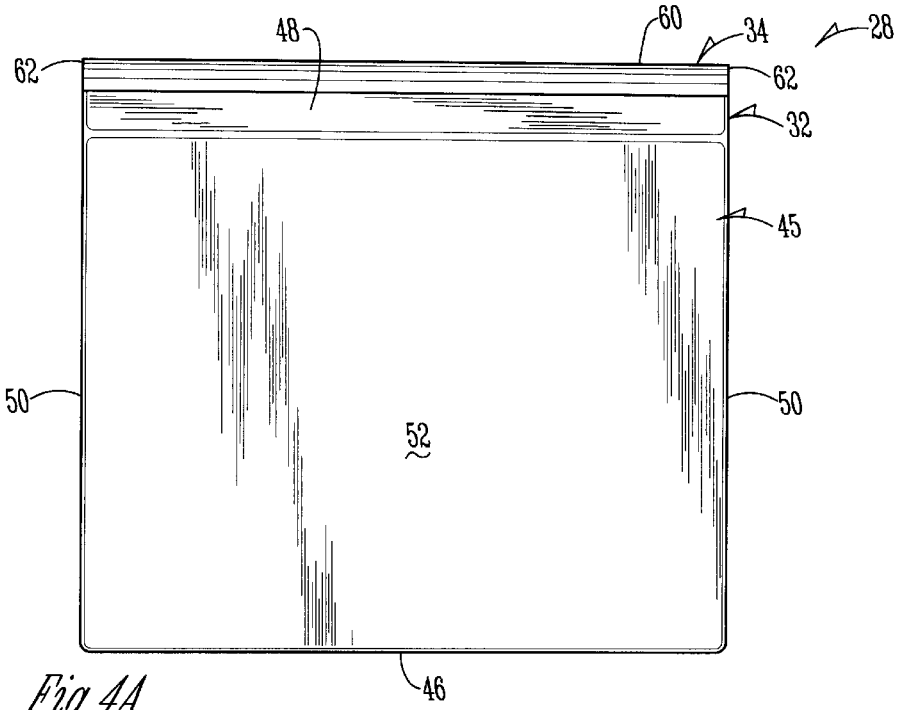
FIG. 4A is a side elevational view as seen from the right-hand side of FIG. 3.
Figure 4B:
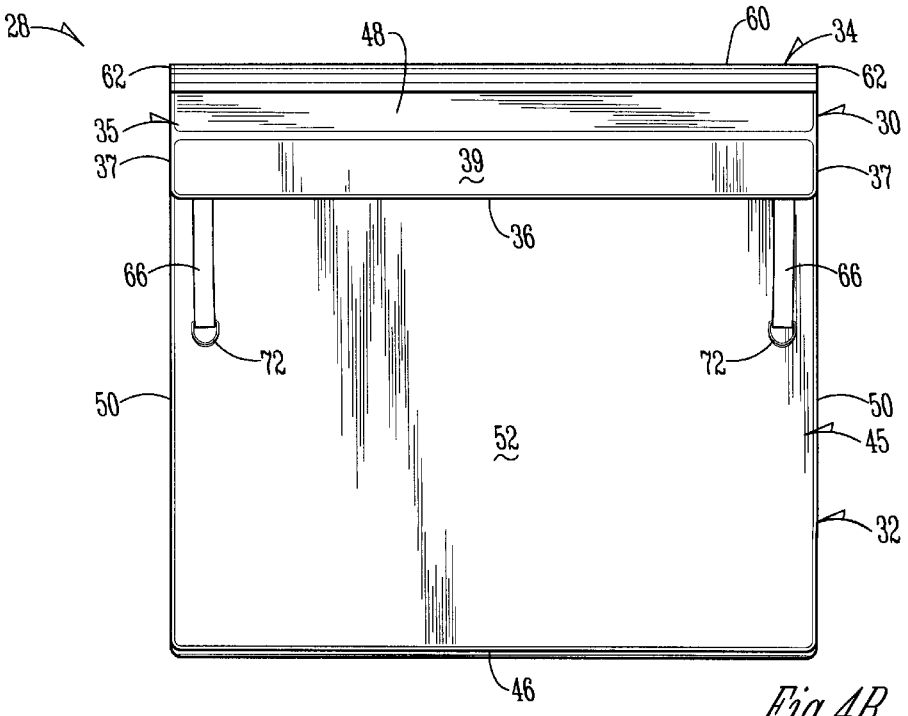
FIG. 4B is a side elevational view as seen from the left-hand side of FIG. 3.

A conventional vaulting horse 10 is shown in FIG. 1A and is comprised of an elongated stiffly padded body 12 having a cover 13 comprised of naugahyde or the like. The body 12 has a top portion 14, opposite ends 16, a bottom portion 18 and opposite sides 20.

A support stand 22 has vertical adjustable legs 24 which have foot portions 26 on the lower ends thereof.

Figures 5, 6:
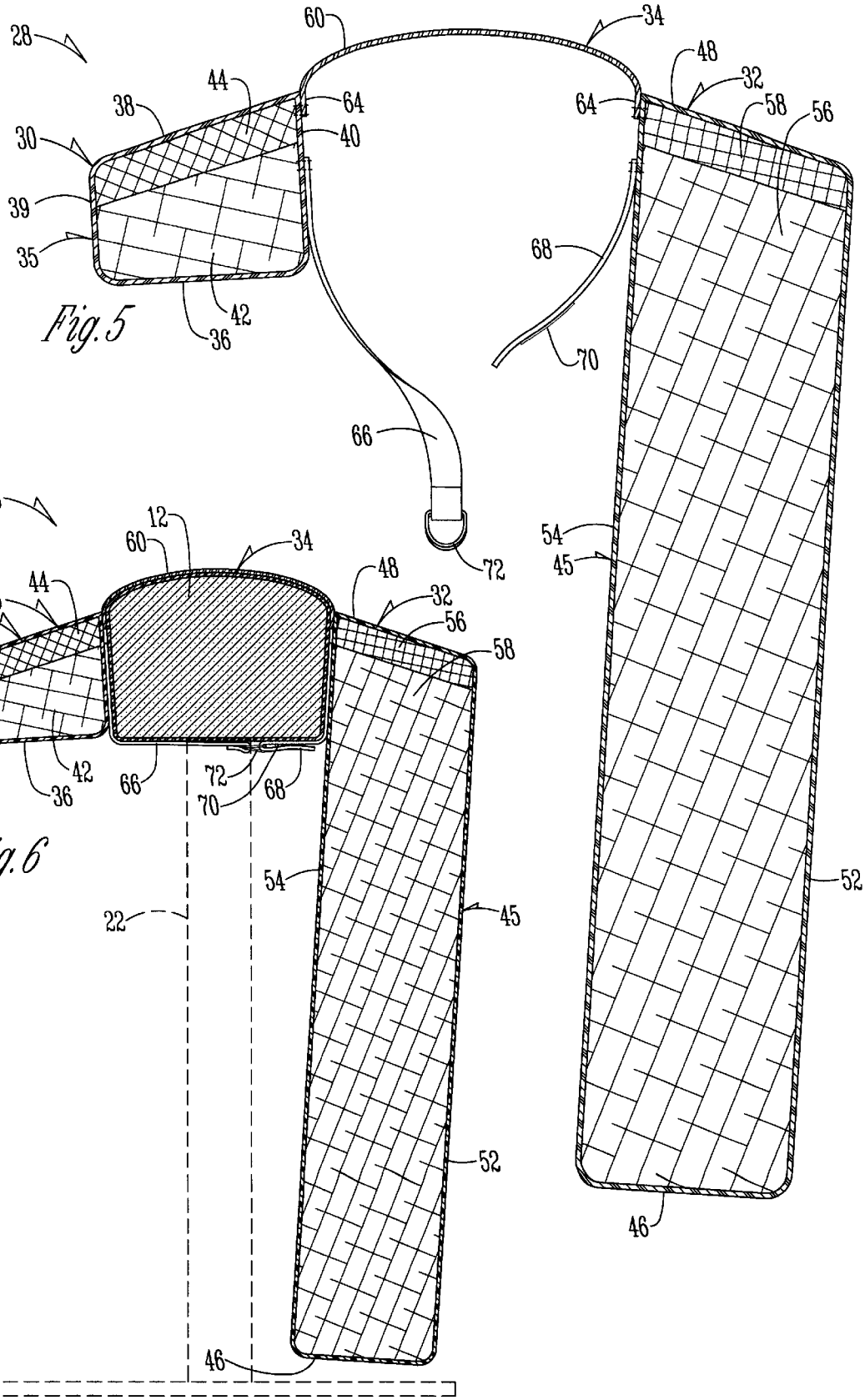
FIG. 5 is a transverse sectional view at an enlarged scale taken on line 5—5 of FIG. 3.
FIG. 6 is a view similar to that of FIG. 5 but showing the pad mounted on a vaulting horse.
Figure 7:
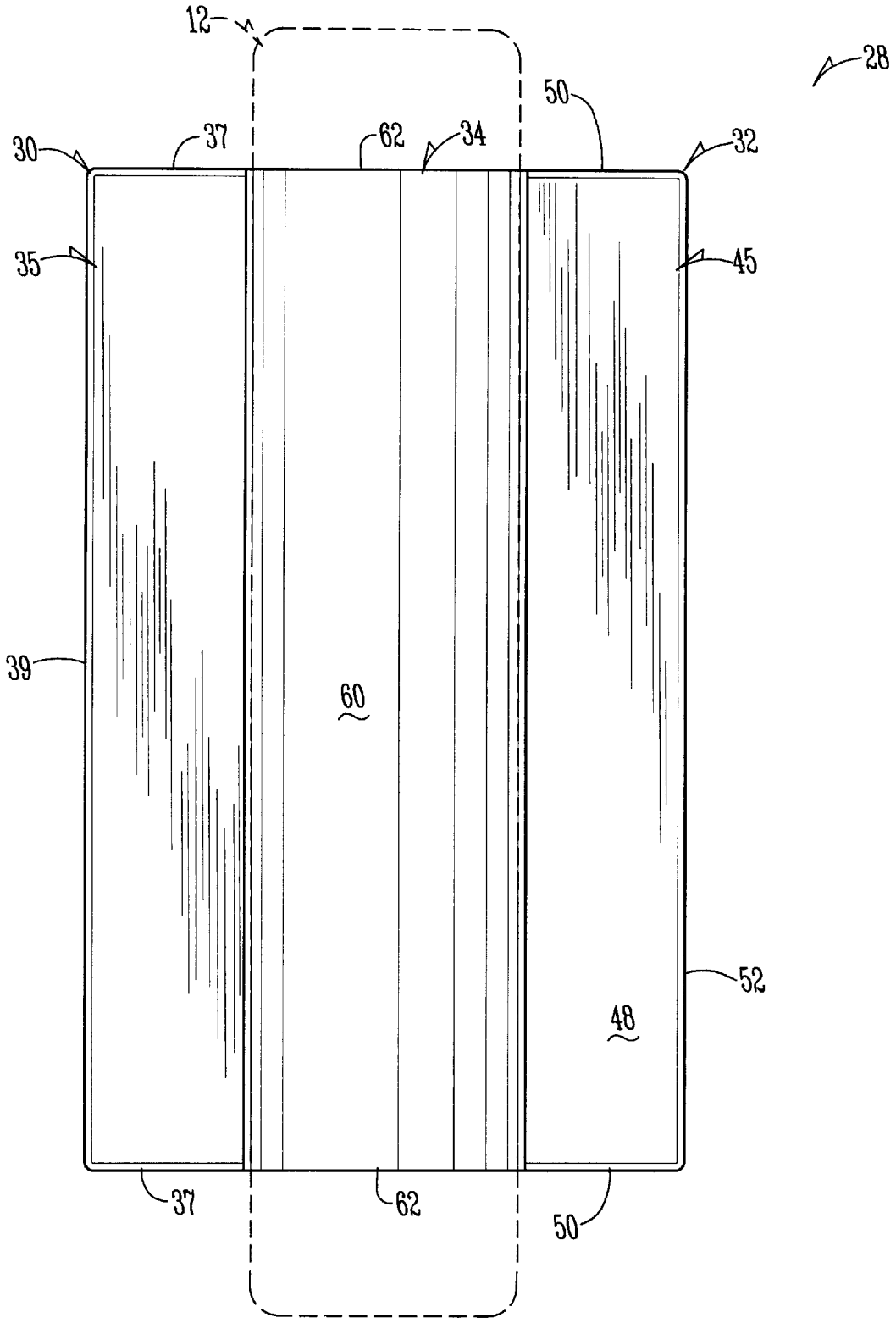
FIG. 7 is an enlarged scale top plan view thereof.

The training pad 28 of this invention is best shown in FIGS. 1 and 6. A first pad 30 is oppositely disposed to a second pad 32 with a flexible blanket 34 spanning the distance therebetween and secured to each of the pads. Specifically, pad 30 has a vinyl cover 35 defining a flat bottom 36 and opposite ends 37. Sloping top surface 38 extends downwardly and outwardly from the blanket 34. Pad 30 has an outer vertical side 39 and an inner vertical side 40. The pad 30 is substantially filled with a polyurethane foam 42 which has a top layer 44 comprised of a firmer polyethylene foam. (FIG. 6). The layer of foam 44 is approximately 2 inches thick.

Pad 32 has a vinyl cover 45 which defines a flat bottom 46 and a sloping top 48 which extends downwardly and outwardly from the blanket 34. Pad 32 has ends 50 and an outer vertical side 52 with an inner vertical side 54. The numeral 56 designates the polyurethane foam in pad 32 which has an upper layer 52 of a stiffer polyethylene foam 58. (FIG. 6). The foam 56 and 58 are identical to the foam 42 and 44, respectively, in pad 30.

The blanket 34 is flexible and is also comprised of naugahyde or the like and should be of the same material as the cover 13 of the vaulting horse 10. This permits the student to become accustomed to the feel of the material of the body 12 even though the training pad 28 extends over the body 12. Blanket 34 has opposite ends 62 and side edges 64 which are stitched to the inner sides 40 and 54 respectively of pads 30 and 32. (FIG. 6). Blanket 34 has a parabolic top 60 which conforms to the parabolic top 14 of the body 12 of vaulting horse 10 (FIG. 6).

A pair of strap segments 66 are stitched to or otherwise secured to the inner side 40 of pad 30. Similarly, a pair of strap segments 68 are sewn or otherwise secured to the inner side 54 of pad 52. A Velcro segment 70 is stitched to or otherwise secured to the lower end of strap segment 68. Similarly, a D-hook 72 is secured to the lower ends of strap segment 66 (FIG. 5).

FIG. 6 shows how the pad 28 is secured to the body 12 of vaulting horse 10. This is accomplished by placing the blanket 34 over the top portion 14 of body 12 which allows the inner sides 40 and 54 of pads 30 and 32 to engage the side 16 of body 12. The weight of each of the pads causes them to bear against the sides 16 of the body 12. The strap segments 66 and 68 at opposite ends of the pad 28 are secured together in conventional manner by threading the lower end of strap segment 68 through the D-hook 72 on strap segment 66. The strap segment 68 is folded upon itself and held in a retaining position by use of the Velcro patch 70 (FIG. 6).

The training pad 28 is obviously easily affixed to the vaulting horse 10 and affords protection to the gymnast during the teaching and the practicing of the vaulting exercise. If necessary, the pad 28 can be turned end for end so that the position of the pads 30 and 32 can be interchanged between the opposite sides 16 of the body 12.

The denser and stiffer layers of foam 44 and 56 prevent each of the pads 30 and 32 from becoming substantially deformed if the hands of the gymnast engage the top portions 38 and 48 of the pads 30 and 32.

It is seen from the foregoing that the process of teaching and practicing the vaulting exercise on a vaulting horse is much safer by reason of the training pad 28 of this invention.

What is claimed is:

1. A training pad for a gymnastic vaulting horse, comprising:

an elongated flexible unpadded blanket having opposite side edges and adapted to span the lateral width of a vaulting horse body, first and second elongated pads having lengths substantially equal to a length of the blanket, each pad having an upper edge secured to one of the side edges of the blanket and adapted to extend downwardly therefrom when the blanket is mounted on a vaulting horse body, the blanket having a width only to span the width of a vaulting horse body so as to position the first and second pads adjacent the opposite sides of a vaulting horse body, the first pad having a vertical thickness sufficient to cover one side of a vaulting horse body, the second pad having a vertical length substantially greater than the vertical thickness of the first pad to permit the second pad to cover the other side of a vaulting horse body to permit a lower edge of the second pad to terminate substantially below a lower edge of the first pad, and attachment means on said training pad for detachably securing the same to the body of a vaulting horse.

2. The device of claim 1 wherein said attachment means is a pair of straps secured to said training pad and adapted to extend around a lower girth of a vaulting horse body.

3. The device of claim 1 wherein said second pad has inner and outer sides; said second pad is of constant thickness defined by said parallel inner and outer sides.

4. The combination of a vaulting horse having an elongated body mounted on an elevated support stand, and a training pad mounted on the elongated body, the combination comprising:

an elongated flexible unpadded blanket extending over an upper surface of the elongated body, and the blanket having opposite side edges, and spanning the lateral width of the elongated body;

first and second elongated pads having lengths substantially equal to the length of the blanket, each pad having an upper edge secured to one of the side edges of the blanket and extending downwardly therefrom, the blanket having a width only to span the width of the elongated body so as to position the first and second pads adjacent the opposite sides of the elongated body, the first pad having a vertical thickness sufficient to cover one side of the elongated body, the second pad having a vertical length substantially greater than a vertical thickness of the first pad to permit the second pad to cover the other side of the vaulting horse body and to permit a lower edge of the second pad to terminate substantially below a lower edge of the first pad, and attachment means on the training pad for detachably securing the same to the elongated body.

5. The combination of claim 4 wherein the exterior material of said blanket and said body have the same exterior surface texture so that a gymnast practicing on said horse with said practice pad mounted thereon will experience the same feel from said blanket as would be felt from said body if said blanket was not in place.

6. The combination of claim 4 wherein the length of said body is greater than that of said pads.

7. The combination of claim 4 wherein said body has substantially vertical sides and inner side portions of said pads engage the vertical sides of said body.

8. The combination of claim 7 wherein said attachment means is a pair of straps secured to the inner sides of said body and extend around a lower girth of said body.

9. The combination of claim 4 wherein each pad has a layer of resilient cushion material at an upper portion thereof.

10. The combination of claim 9 wherein said pads are filled with resilient foam, with a top layer of foam in each pad which has a less resilient and more firm quality than the foam in the remainder of said pads.

11. The combination of claim 4 wherein an upper portion of each pad extends downwardly and outwardly from the opposite edges of said blanket.

12. The combination of claim 4 wherein the top of said body has a parabolic-shaped surface with elongated side edges, with the upper portions of said pads extending downwardly and outwardly from the side edges of said body.

* * * * *